US008750774B2

(12) United States Patent
Gon

(10) Patent No.: US 8,750,774 B2
(45) Date of Patent: Jun. 10, 2014

(54) FIXING DEVICE AND IMAGE FORMING APPARATUS INCLUDING THE SAME

(75) Inventor: Syoukou Gon, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 98 days.

(21) Appl. No.: 13/613,380

(22) Filed: Sep. 13, 2012

(65) Prior Publication Data

US 2013/0071136 A1 Mar. 21, 2013

(30) Foreign Application Priority Data

Sep. 21, 2011 (JP) ..... 2011-205442

(51) Int. Cl.
*G03G 15/20* (2006.01)

(52) U.S. Cl.
USPC ..... 399/328; 399/33; 399/67; 399/320

(58) Field of Classification Search
USPC ..... 399/33, 67, 69, 122, 320, 328
See application file for complete search history.

(56) References Cited

U.S. PATENT DOCUMENTS

2011/0182637 A1* 7/2011 Okada ..... 399/333
2011/0243621 A1* 10/2011 Gon ..... 399/328

FOREIGN PATENT DOCUMENTS

| | | |
|---|---|---|
| JP | 2000-162912 | 6/2000 |
| JP | 2001-318545 | 11/2001 |
| JP | 2009-150972 | 7/2009 |
| JP | 2009-198665 | 9/2009 |

* cited by examiner

*Primary Examiner* — Walter L Lindsay, Jr.
*Assistant Examiner* — Roy Y Yi
(74) *Attorney, Agent, or Firm* — Morgan, Lewis & Bockius LLP

(57) ABSTRACT

A magnetic core includes a plurality of first core portions arranged to surround a coil in a direction perpendicular to a conveying direction of a recording medium, and a second core portions disposed closer to a heating member than the first core portion on both end portions in the direction perpendicular to the conveying direction of the recording medium in a hollow portion formed by a coil loop. The second core portion has thermal capacity smaller than that of the first core portion. Curie temperature of the second core portion is a temperature of the second core portion or higher when the heating member becomes a fixable temperature and is a cooling set temperature of the coil or lower.

6 Claims, 8 Drawing Sheets

FIXING DEVICE AND IMAGE FORMING APPARATUS INCLUDING THE SAME

INCORPORATION BY REFERENCE

This application is based on and claims the benefit of priority from Japanese Patent Application No. 2011-205442 filed on Sep. 21, 2011, the contents of which are hereby incorporated by reference.

BACKGROUND

1. Field

The present disclosure relates to a fixing device used for a copier, a printer, a facsimile, and a multifunctional peripheral thereof, and to an image forming apparatus including the fixing device. In particular, the present disclosure relates to an electromagnetic induction heating type fixing device and an image forming apparatus including the fixing device.

2. Background

Conventionally, the electromagnetic induction heating type fixing device has a structure in which a magnetic flux generated by an exciting coil causes eddy current in an induction heating layer disposed in a heating member, and the induction heating layer is heated by Joule heat generated by the eddy current so that the heating member is heated to a predetermined fixing temperature. This type of fixing device can reduce thermal capacity of the induction heating layer. Therefore, a warm-up time for starting the device can be shortened, and hence compact and high thermal conversion efficiency can be obtained. However, in the case of small size of paper sheet to be conveyed, a paper passing region of the heating member through which the paper sheet passes is cooled to be low temperature as the paper sheet absorbs heat from a surface of the heating member, while a non-paper passing region through which the paper sheet does not pass remains at high temperature. In particular, when the paper passing region of the heating member is maintained at fixing temperature in the case where paper sheets pass through continuously, temperature of the non-paper passing region of the heating member rises excessively so that temperature of the heating member or the exciting coil exceeds its heat resistance limit temperature resulting in a malfunction such as a breakdown of the member.

Therefore, related techniques for solving the above-mentioned malfunction are proposed. Fixing devices of a first related technique and a second related technique include a magnetic core having Curie temperature set to be higher than the fixing temperature, and a coil which generates a magnetic flux for heating the heating member by electromagnetic induction with the magnetic core. Further, the magnetic core has different Curie temperatures in a direction perpendicular to a paper conveying direction, in order to prevent a large difference of temperature between the paper passing region with which the paper sheet contacts and the non-paper passing region with which the paper sheet does not contact on the surface of the heating member, in the case where a lot of small size of paper sheets are fixed continuously. In other words, end magnetic cores on both end portions corresponding to the non-paper passing region have Curie temperature lower than that of a middle magnetic core corresponding to the paper passing region. Therefore, in the case where a toner image is fixed on a small size of paper sheet, when the temperature of the non-paper passing region rises excessively so that the temperature of the end magnetic core becomes the Curie temperature or higher by heat radiation or heat conduction from the heating member, a heating value of the non-paper passing region is decreased because of a decrease of magnetic permeability of the end magnetic cores. As a result, the temperature of the non-paper passing region of the heating member is lowered.

In addition, a fixing device of a third related technique includes a plurality of magnetic cores arranged in the direction perpendicular to the paper conveying direction along the coil which generates the magnetic flux for induction heating of the heating member. The Curie temperature of a portion of the magnetic core corresponding to the non-paper passing region is set to a temperature range between the temperature of the portion of the magnetic core corresponding to the non-paper passing region when the temperature of the heating member becomes the fixing temperature or higher and the temperature lower than the temperature of the portion of the magnetic core corresponding to the non-paper passing region when the temperature of the heating member or the coil becomes the heat resistance temperature. Thus, the paper sheet can be heated and fixed while preventing the temperatures of the heating member and the coil from exceeding the heat resistance limit temperature resulting in a breakdown of the member.

In addition, in a fixing device of a fourth related technique, the magnetic core includes a plurality of trapezoidal first magnetic cores arranged in the direction perpendicular to the paper conveying direction so as to cover the coil which generates a magnetic flux for induction heating, and a plurality of second magnetic cores arranged in the direction perpendicular to the paper conveying direction in a gap formed by a loop of a coil wound in a looped shape. The Curie temperature of the end magnetic cores disposed corresponding to the non-paper passing region among the second magnetic cores is set lower than the Curie temperature of the first magnetic core. Further, because the end magnetic cores are disposed separately from the first magnetic core, the thermal capacity thereof is smaller than that of the first magnetic core. Therefore, when the temperature of the non-paper passing region rises excessively, the temperature of the end magnetic cores rise relatively fast by thermal radiation or heat conduction from the heating member to the end magnetic cores so that excessive rise of temperature of the heating member in the non-paper passing region is prevented rapidly.

Usually, in order to rapidly suppress excessive rise of temperature of the heating member in the non-paper passing region, it is necessary to set good temperature following property of the end magnetic cores to a temperature variation of the heating member. In addition, for example, the coil is wound in a loop shape a plurality of turns, and is formed and cured by heating to melt a melting layer on the surface of the coil. Therefore, it is necessary to cool the coil so that the coil temperature does not rise to a predetermined temperature (coil cooling temperature) or higher in order to prevent the coil temperature from rising excessively so that the coil is broken or a shape of the coil is lost. Affected by cooling the coil, the temperature of the end magnetic cores disposed close to the coil is not raised to the coil cooling temperature or higher. Therefore, the Curie temperature of the end magnetic cores should be set in view of the above-mentioned discussion. In other words, it is necessary to set the Curie temperature of the end magnetic cores disposed close to the coil to the temperature in view of the temperature cooling the coil. However, in the fixing devices of the above-mentioned first to third related techniques, the end magnetic cores do not have good temperature following property to a temperature variation of the heating member. In addition, in the fixing device of the fourth related technique, the Curie temperature of a lower limit of the end magnetic cores is set, but the Curie temperature of an upper limit is not set. Therefore, the temperature of the heating member may exceed the heat resistance limit temperature so that the heating member may be broken.

SUMMARY

It is an object of the present disclosure to provide a fixing device and an image forming apparatus including the fixing device in which end magnetic cores have good temperature following property to a temperature variation of a heating member, and the heating member does not exceed a heat resistance limit temperature to be broken.

A fixing device according to an aspect of the present disclosure includes a heating member, a pressure member pressed to the heating member, a nip portion formed by pressure between the heating member and the pressure member so as to sandwich a recording medium carrying an unfixed toner image for melting and fixing the unfixed toner image on the recording medium, a coil wound in a loop shape in a longitudinal direction of the heating member so as to generate a magnetic flux for induction heating of the heating member, a cooling mechanism for cooling the coil, a magnetic core disposed close to the coil in a direction perpendicular to a conveying direction of the recording medium so as to guide the magnetic flux to an induction heating layer of the heating member, and a support member which is opposed to a surface of the heating member and has a mounting surface opposite to a surface opposed to the heating member, on which the coil and the magnetic core are mounted. The magnetic core includes a plurality of first core portions arranged to surround the coil in the direction perpendicular to the conveying direction of the recording medium, and a second core portions disposed closer to the heating member than the first core portion on both end portions in the direction perpendicular to the conveying direction of the recording medium in a hollow portion formed by the coil loop. The second core portion has a thermal capacity smaller than that of the first core portion, and Curie temperature of the second core portion is a temperature of the second core portion or higher when a temperature of the heating member becomes a fixable temperature and is a cooling set temperature of the coil or lower.

Other objects of the present disclosure and specific advantages obtained from the present disclosure will become more apparent from the description of embodiments given below.

DETAILED DESCRIPTION

Hereinafter, embodiments of the present disclosure are described with reference to the attached drawings, but the present disclosure is not limited to the embodiments. In addition, applications of the present disclosure and terms described here are not limited to those in the embodiments.

First Embodiment

Figure 1:
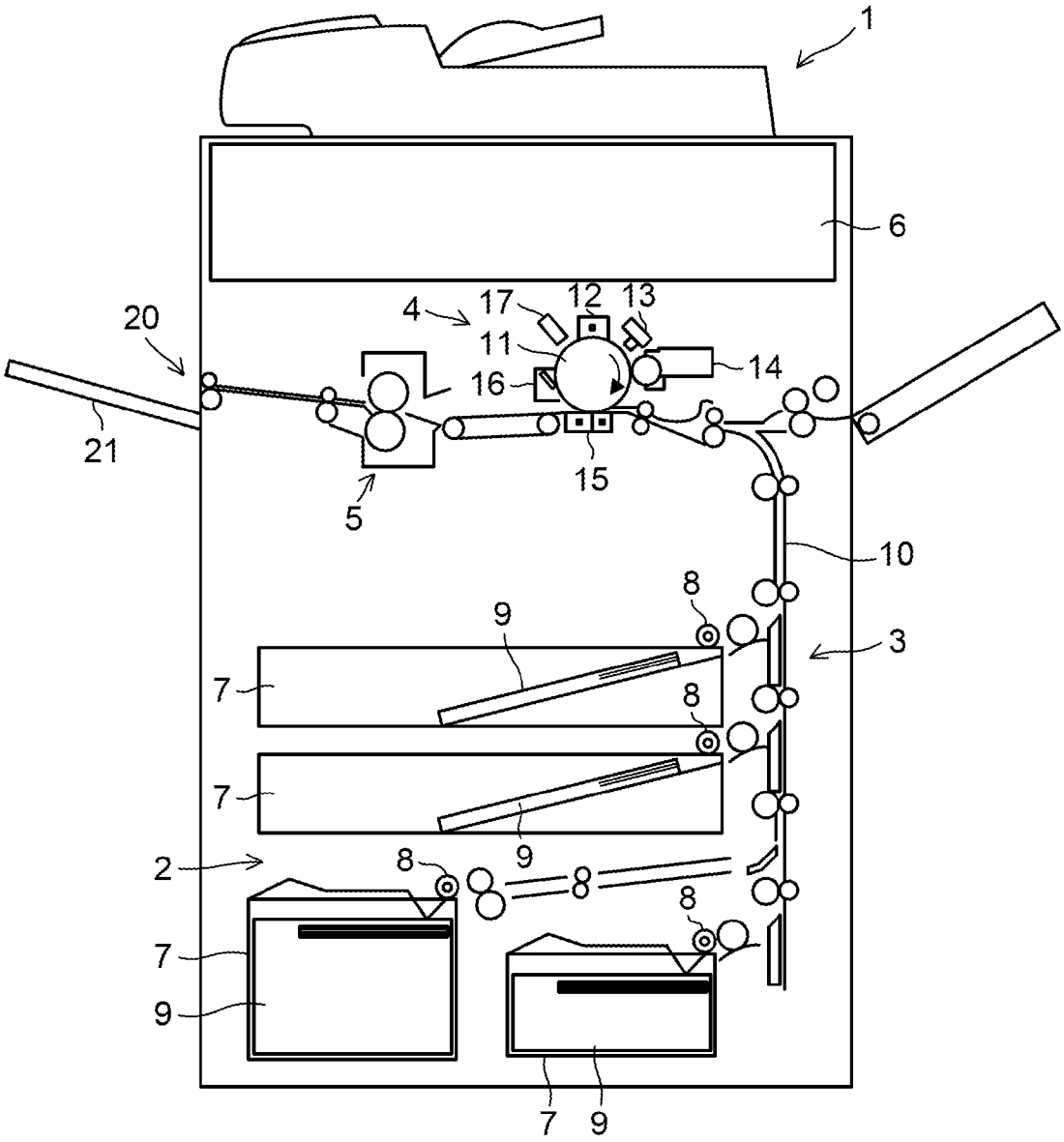
FIG. 1 is a diagram illustrating a structure of an image forming apparatus including a fixing device according to a first embodiment of the present disclosure.

FIG. 1 is a diagram illustrating a structure of an image forming apparatus including a fixing device according to an embodiment of the present disclosure. An image forming apparatus 1 includes a paper sheet feeder 2 disposed in a lower part thereof, a paper sheet transporting portion 3 disposed on the side of the paper sheet feeder 2, an image forming portion 4 disposed above the paper sheet transporting portion 3, a fixing device 5 disposed closer to a discharge side of a paper sheet 9 as a recording medium than the image forming portion 4, and an image reading portion 6 disposed above the image forming portion 4 and the fixing device 5.

The paper sheet feeder 2 includes a plurality of sheet feed cassettes 7 housing the paper sheets 9, so as to feed the paper sheet 9 one by one to the paper sheet transporting portion 3 from a selected sheet feed cassette 7 among the plurality of sheet feed cassettes 7, by rotation of a paper feed roller 8.

The paper sheet 9 sent to the paper sheet transporting portion 3 is transported to the image forming portion 4 via a paper transport pass 10 included in the paper sheet transporting portion 3. The image forming portion 4, which forms a toner image on the paper sheet 9 by an electrophotographic process, includes a photoreceptor 11 supported in a rotational manner in an arrow direction in FIG. 1, and there are disposed a charging unit 12, an exposing unit 13, a developing unit 14, a transfer unit 15, a cleaning unit 16, and a static eliminator unit 17 around the photoreceptor 11 along a rotation direction thereof.

The charging unit 12 includes a charging wire to which a high voltage is applied. When this charging wire generates corona discharge so as to apply a predetermined potential to a surface of the photoreceptor 11, the surface of the photoreceptor 11 is uniformly charged. Further, when the photoreceptor 11 is irradiated with light based on image data of a document read by the image reading portion 6 from the exposing unit 13, the surface potential of the photoreceptor 11 is selectively attenuated so that an electrostatic latent image is formed on the surface of the photoreceptor 11.

Next, the developing unit 14 develops the electrostatic latent image on the surface of the photoreceptor 11, and hence a toner image is formed on the surface of the photoreceptor 11. This toner image is transferred by the transfer unit 15 onto the paper sheet 9 fed to between the photoreceptor 11 and the transfer unit 15.

The paper sheet 9 onto which the toner image is transferred is transported to the fixing device 5 disposed on the downstream side of the image forming portion 4 in the paper conveying direction. The fixing device 5 heats and presses the paper sheet 9 so that the toner image on the paper sheet 9 is melted and fixed. Next, the paper sheet 9 on which the toner image is fixed is discharged onto a discharge tray 21 by a discharge roller pair 20.

After the transfer of the toner image onto the paper sheet 9 by the transfer unit 15, toner remaining on the surface of the photoreceptor 11 is removed by the cleaning unit 16, and residual charge on the surface of the photoreceptor 11 is removed by the static eliminator unit 17. Then, the photoreceptor 11 is charged again by the charging unit 12, and image formation is performed in the same manner.

Figure 2:
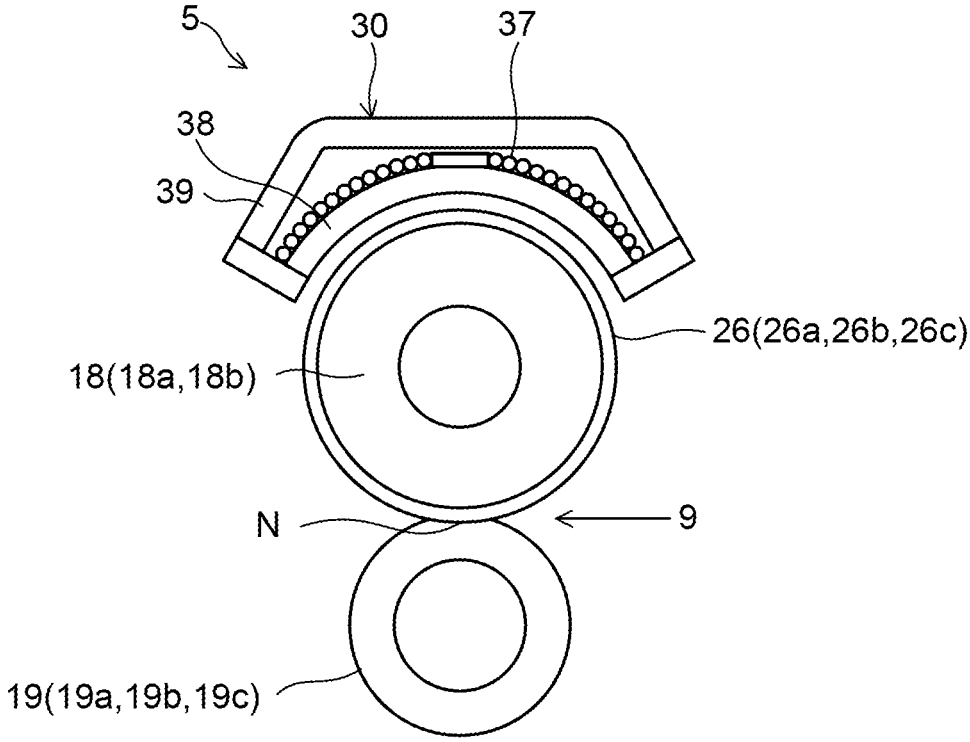
FIG. 2 is a side cross-sectional view illustrating the fixing device including an induction heating portion according to the first embodiment of the present disclosure.

The fixing device 5 is structured as illustrated in FIG. 2. FIG. 2 is a side cross-sectional view illustrating the fixing device.

The fixing device 5, which uses an electromagnetic induction heating method, includes a heating belt 26 as a heating member, a pressure roller 19 as the pressure member, a fixing roller 18 to which the heating belt 26 is attached integrally, and an induction heating portion 30 for supplying a magnetic flux to the heating belt 26. The pressure roller 19 and the fixing roller 18 are supported in a rotatable manner in a longitudinal direction of a housing (not shown) of the fixing device 5, and the induction heating portion 30 is immovably fixed to the housing.

The heating belt 26 is an endless heat resistance belt and includes, in order from the inner side, an induction heating layer 26*a* made of electroformed nickel having thickness of 30 to 50 μm, an elastic layer 26*b* made of silicone rubber or the like having a thickness of 200 to 500 μm, and a release layer 26*c* made of fluoride resin or the like for improving release property when the unfixed toner image is melted and fixed in a nip portion N, which are laminated.

The inner circumference surface of the heating belt 26 is stretched around the fixing roller 18 so that the heating belt 26 is rotated integrally with the fixing roller 18. The fixing roller 18 has an outer diameter of 39.8 mm and includes a cored bar 18*a* made of stainless steel and an elastic layer 18*b* made of silicone rubber having a thickness of 5 to 10 mm on the cored bar 18*a*. The heating belt 26 is stretched around the elastic layer 18*b*.

The pressure roller 19 includes a cylindrical cored bar 19*a*, an elastic layer 19*b* formed on the cored bar 19*a*, and a release layer 19*c* covering the surface of the elastic layer 19*b*. The pressure roller 19 has an outer diameter of 35 mm and includes the elastic layer 19*b* made of silicone rubber having a thickness of 2 to 5 mm on the cored bar 19*a* made of stainless steel, and the release layer 19*c* made of fluoride resin or the like on the elastic layer 19*b*. In addition, the pressure roller 19 is driven to rotate by a power source such as a motor (not shown), and the heating belt 26 rotates to follow the rotation of the pressure roller 19. The nip portion N is formed in the portion where the pressure roller 19 and the heating belt 26 are pressed to contact with each other. In the nip portion N, the unfixed toner image on the transported paper sheet 9 is heated and pressed so that the toner image is fixed on the paper sheet 9.

The induction heating portion 30 includes a coil 37, a bobbin 38, and a magnetic core 39, so as to make the heating belt 26 generate heat by electromagnetic induction. The induction heating portion 30 extends in the longitudinal direction (from the front side to the backside of the paper of FIG. 2) and is disposed to be opposed to the heating belt 26 so as to cover substantially a half of the outer circumference of the heating belt 26.

The coil 37 is wound a plurality of turns in a loop shape along the longitudinal direction of the heating belt 26 and attached to the bobbin 38. In addition, the coil 37 is connected to a power supply (not shown) and is supplied with high frequency current from the power supply so as to generate alternating magnetic flux. The magnetic flux from the coil 37 passes through the magnetic core 39, is guided in the direction parallel to the paper of FIG. 2, and passes through along the induction heating layer 26*a* of the heating belt 26. In accordance with the alternating change of intensity of magnetic flux passing through the induction heating layer 26*a*, eddy current is generated in the induction heating layer 26*a*. When the eddy current flows in the induction heating layer 26*a*, Joule heat is generated in the induction heating layer 26 by resistance of the induction heating layer 26*a* so that the heating belt 26 is heated (self-heated).

When the heating belt 26 is heated, the temperature of the heating belt 26 rises to a predetermined temperature so that the paper sheet 9 held in the nip portion N is heated while being pressed by the pressure roller 19. Thus, the toner in a powder state on the paper sheet 9 is melted and fixed to the paper sheet 9. In this way, because the heating belt 26 is made of a thin material having good heat conduction property with small thermal capacity, temperature of the heating belt 26 rises in a short time so that the image formation is started rapidly.

Figure 3:
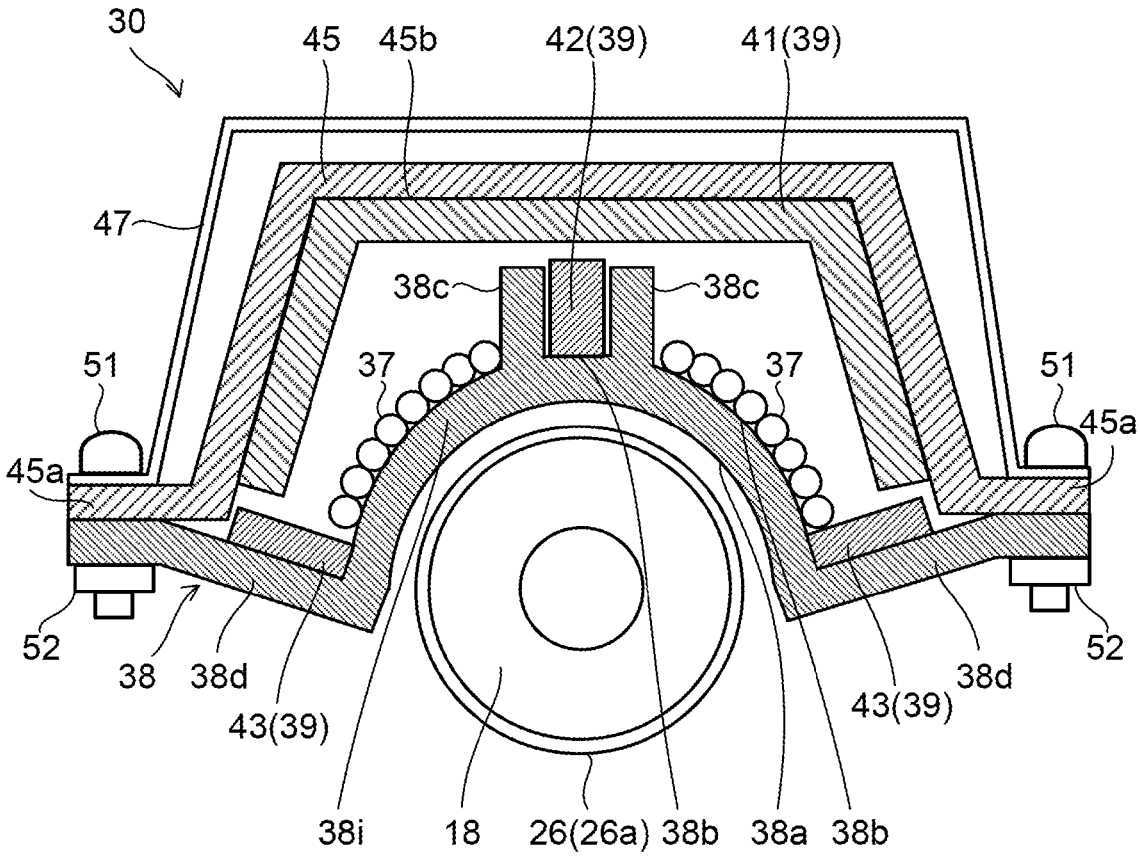
FIG. 3 is a side cross-sectional view illustrating the induction heating portion according to the first embodiment of the present disclosure.

A detailed structure of the induction heating portion 30 is illustrated in FIG. 3. FIG. 3 is a side cross-sectional view illustrating the induction heating portion 30.

As described above, the induction heating portion 30 includes the coil 37, the bobbin 38 as a support member, and the magnetic core 39. The magnetic core 39 includes arch cores 41 as a first core portion, end center cores 42 as a second core portion, and side cores 43. Further, the induction heating portion 30 includes an arch core holder 45 for attaching the arch cores 41, and a cover member 47 covering the magnetic core 39 and the coil 37.

The bobbin 38 is disposed coaxially with the rotation center axis of the fixing roller 18 at a predetermined space with the surface of the heating belt 26, and includes an arc portion 38*i* covering substantially a half of the surface of the heating belt 26, and flange portions 38*d* each of which extends from each end of the arc portion 38*i*. The arc portion 38*i* and the flange portions 38*d* constitute a skeletal frame of the bobbin 38 having a thickness of 1 to 2 mm, preferably a thickness of 1.5 mm in order to maintain strength of the skeletal frame, and are made of heat resistant resin such as liquid crystal polymer (LCP) resin, polyethylene terephthalate (PET) resin, polyphenylene sulfide (PPS) resin, or the like, in order to resist heat radiation from the heating belt 26.

The arc portion 38*i* of the bobbin 38 has an opposed surface 38*a* opposed to a surface of the heating belt 26 at a predetermined space, and an arcuate mounting surface 38*b* on the opposite side to the opposed surface 38*a*. On a substantial center of the mounting surface 38*b*, namely on the line connecting the rotation center axes of the fixing roller 18 and the pressure roller 19 (see FIG. 2), a pair of end center cores 42 is attached with adhesive. Around the end center cores 42, there are standing wall portions 38*c* formed to rise from the mounting surface 38*b* and extends in the longitudinal direction (front and back direction of the paper of FIG. 3). In addition, the coil 37 is attached to the mounting surface 38*b*. The space between the surface of the heating belt 26 and the opposed surface 38*a* of the bobbin 38 is set to 1.5 to 3 mm, for example, in order that they do not contact with each other when the heating belt 26 rotates, and the end center cores 42 are disposed apart from the surface of the heating belt 26 by 4 mm.

The coil 37 is constituted of a plurality of enameled wires coated with a fusing layer that are intertwined. For instance, AIW wire having a heat resistance temperature of approximately 200 degrees Celsius is used. The coil 37 is wound along the mounting surface 38*b* to have a circular cross section around the longitudinal direction (front and back direction of the paper of FIG. 3) in a loop shape. In this state, the coil 37 is heated so that the fusing layer is melted and is afterward cooled to be formed in a predetermined shape (loop shape). In this case, the heat resistance temperature of the fusing layer of the coil 37 is 180 degrees Celsius, for example. Therefore, the cooling set temperature of the coil 37 in consideration of the heat resistance temperature of the coil 37 is approximately 160 degrees Celsius. The coil 37 cured in the predetermined shape is disposed around the standing wall portion 38*c* of the bobbin 38 and is attached onto the mounting surface 38*b* with silicone adhesive or the like.

On the arc portion 38*i* side of each of the flange portions 38*d*, a plurality of side cores 43 are arranged in the longitudinal direction of the flange portion 38*d* and are attached with adhesive. In addition, on the outer rim side of the flange portion 38*d*, the arch core holder 45 is attached.

Figure 4:
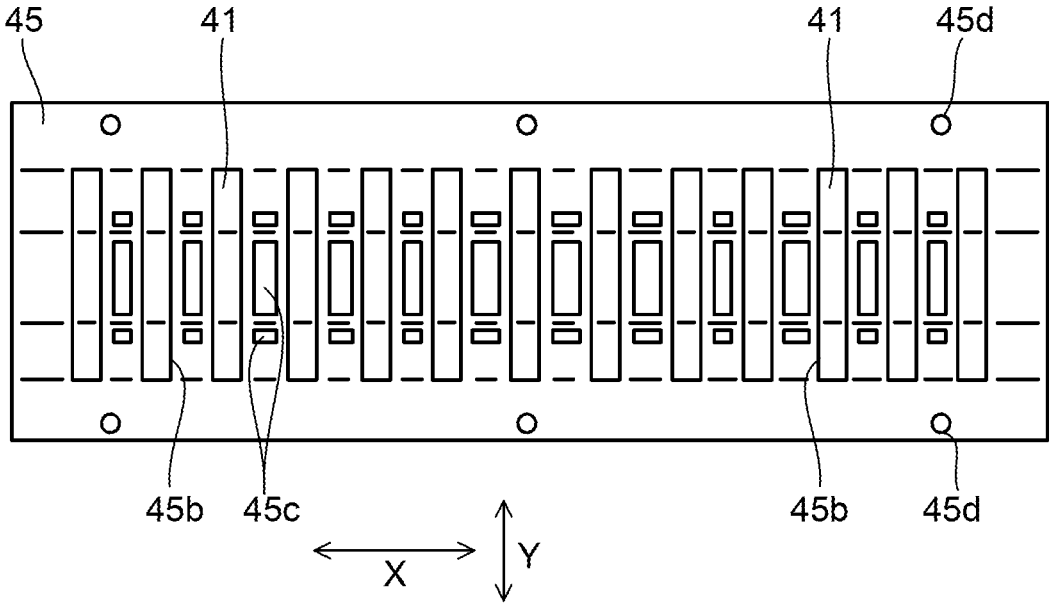
FIG. 4 is a plan view illustrating an arrangement of an arch core with respect to an arch core holder of the induction heating portion according to the first embodiment of the present disclosure.

The arch core holder 45 includes holder flange portions 45*a* that are attached to the flange portions 38*d* of the bobbin 38, and a plurality of core attaching portions 45*b* formed in an arch shape from the holder flange portions 45*a* and arranged in the longitudinal direction (see FIG. 4). The arch core 41 having substantially the same arch shape as the core attaching portion 45*b* is attached to each of the core attaching portions 45*b* with adhesive.

Therefore, when the arch cores 41, the end center cores 42, and the side cores 43 are attached to the bobbin 38 and the arch core holder 45 at the predetermined positions as described above, the arch core 41 and the side core 43 surround the outside of the coil 37. In addition, the end center cores 42 are disposed closer to the surface of the heating belt 26 than the arch cores 41. Further, the coil 37 is surrounded by the surface of the heating belt 26, the side cores 43, the arch cores 41, and the end center core 42. When high frequency current is supplied to the coil 37, the magnetic flux generated from the coil 37 is guided to the side cores 43, the arch cores 41, and the end center core 42 so as to flow along the heating belt 26. In this case, eddy current is generated in the induction heating layer 26*a* of the heating belt 26 so that Joule heat is generated in the induction heating layer 26*a* by resistance of the induction heating layer 26*a*. Thus, the heating belt 26 generates heat.

The cover member 47 shields magnetic field generated from the induction heating portion 30, and has a structure in which the coil 37 and the magnetic core 39 are surrounded by aluminum plate material, for example, on four sides from the opposite side of the bobbin 38. The cover member 47 is attached to the bobbin 38 by stacking the holder flange portion 45*a* of the arch core holder 45 and the flange portion of the cover member 47 in this order on the flange portion 38*d* of the bobbin 38, and fastening a bolt 51 with a nut 52 in this state.

Figure 5:
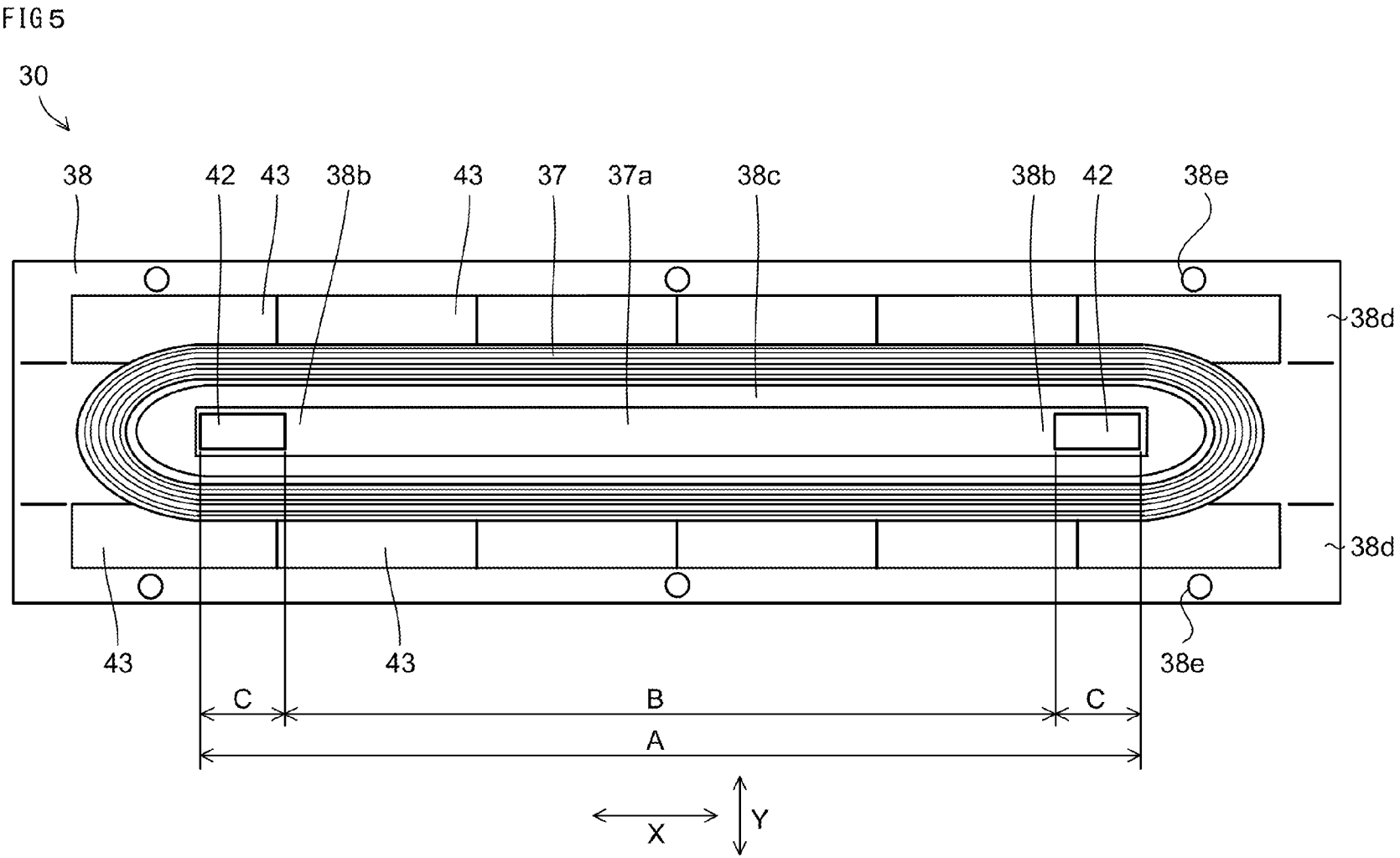
FIG. 5 is a plan view illustrating an arrangement of end center cores with respect to a bobbin of the induction heating portion according to the first embodiment of the present disclosure.
Figure 6:
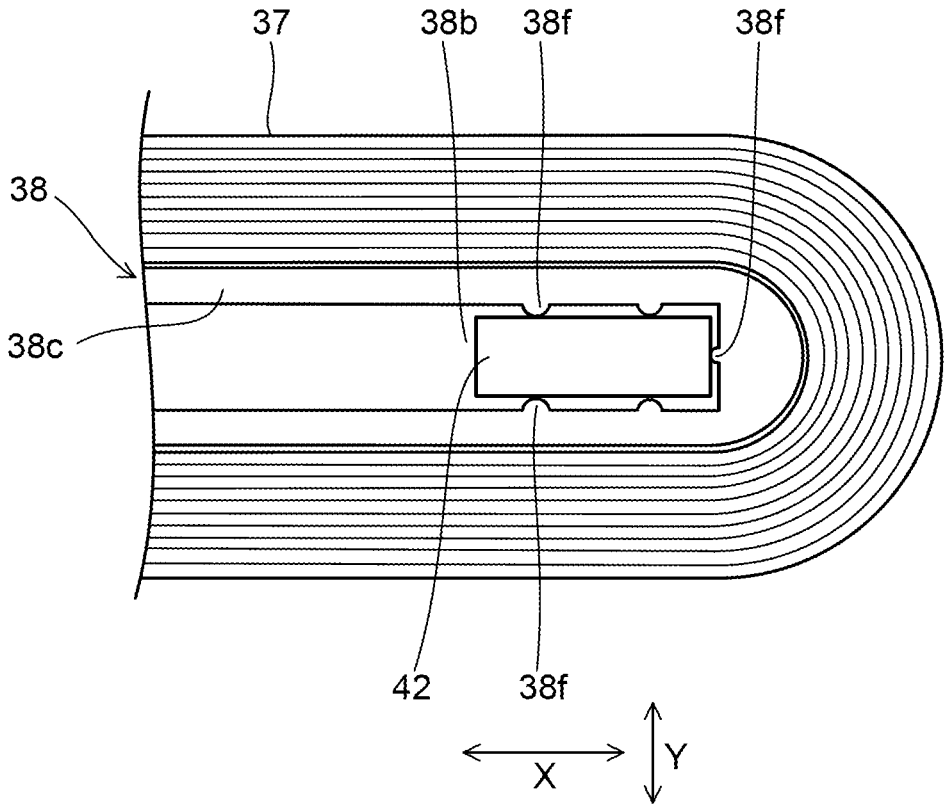
FIG. 6 is a plan view illustrating attachment of the end center cores to the bobbin according to the first embodiment of the present disclosure.

FIGS. 4 to 6 illustrate detailed layout of the coil 37 and the magnetic core 39. FIG. 4 is a plan view illustrating an arrangement of the arch cores 41 with respect to the arch core holder 45 viewed from the lower side (bobbin 38 side) in FIG. 3. FIG. 5 is a plan view illustrating an arrangement of the coil 37, the end center cores 42 and the side cores 43 with respect to the bobbin 38 viewed from the upper side (arch core holder 45 side) in FIG. 3. In addition, FIG. 6 is a plan view illustrating details of the attachment of the end center cores 42.

As illustrated in FIG. 4, the core attaching portions 45*b* for attaching the arch cores 41 to a predetermined position is formed in the arch core holder 45. A plurality of core attaching portions 45*b* are formed with a substantially uniform interval in a longitudinal direction X (perpendicular to the paper conveying direction). Holder opening portions 45*c* are formed between neighboring core attaching portions 45*b*, and around the core attaching portion 45*b*, there are formed a plurality of threaded holes 45*d* in which the bolts 51 (see FIG. 3) for attaching the arch core holder 45 to the bobbin 38 (see FIG. 3) are engaged.

The arch cores 41 are formed of high magnetic permeability ferrite such as Mn—Zn alloy in an arch shape to have a rectangular cross section. The Curie temperature of the arch core 41 is set to a temperature corresponding to the temperature of the arch core 41 when the nip portion N becomes the fixable temperature, or to a higher temperature. If the temperature of the arch core 41 exceeds the Curie temperature, the magnetic permeability of the arch core 41 drops rapidly so that the arch core 41 does not act as a magnetic material. The Curie temperature of the arch core 41 is set to 200 degrees Celsius, for example, by adjusting a ratio between Mn and Zn of the Mn—Zn alloy. Dimensions of the arch core 41 are set as follows. For instance, a width (length in the longitudinal direction X) is set to 10 mm, and a thickness is set to 4.5 mm. A plurality of arch cores 41 are arranged within the length of the coil 37 (see FIG. 5) in the longitudinal direction X. For instance, thirteen arch cores 41 are arranged uniformly in a section having a length of 310 mm. Calculating the thermal capacity of the arch core 41 from dimensions, specific gravity, and specific heat of the arch core 41, the thermal capacity of one arch core 41 becomes 15 J/K. Because the arch core 41 has an arch shape, the thermal capacity becomes relatively large. In addition, because the arch cores 41 are disposed relatively apart from the heating member 26, temperature following property of the arch cores 41 to a temperature variation of the heating member 26 is inferior to that of the end center core 42.

As illustrated in FIG. 5, the standing wall portions 38*c* formed to rise from the mounting surface 38*b*, the flange portions 38*d*, and a plurality of threaded holes 38*e* engaging the bolts 51 (see FIG. 3) are formed in the bobbin 38. The plurality of side cores 43 are attached to the flange portion 38*d*.

The side core 43 is formed of high magnetic permeability ferrite such as an Mn—Zn alloy in a rectangular block shape, and the Curie temperature thereof is set to a temperature of the side core 43 when the nip portion N becomes the fixable temperature, or to a higher temperature. If the temperature of the side core 43 exceeds the Curie temperature, the magnetic permeability of the side core 43 is rapidly lowered so that the side core 43 does not act as a magnetic material. The Curie temperature of the side core 43 is set to 120 degrees Celsius, for example, by adjusting a ratio between Mn and Zn of the Mn—Zn alloy. Dimensions of the side core 43 are set as follows. For instance, about the side cores 43, a length (in the longitudinal direction X) is set to 57 mm, a width (length in a Y direction) is set to 12 mm, and a thickness is set to 3.5 mm. Six side cores 43 are disposed on one flange portion 38*d* of the bobbin 38 so that side surfaces thereof contact with each other in the longitudinal direction X. In addition, six side cores 43 are disposed on other flange portion 38*d* so that side surfaces thereof contact with each other in the longitudinal direction X. Calculating the thermal capacity of the side cores 43 from dimensions, specific gravity, and specific heat of the side core 43, the thermal capacity of one side core 43 becomes 10 J/K. Because of dimensions of the side cores 43 and arrangement of the same contacting with each other, the thermal capacity thereof is relatively large. Therefore, temperature following property of the side cores 43 to a temperature variation of the heating member 26 is inferior to that of the end center core 42.

The standing wall portion 38*c* of the bobbin 38 includes a pair of wall portions opposed to each other, extending in the longitudinal direction X, and wall portions having an arc outer rim formed on both end portions of the pair of wall portion in the longitudinal direction X.

The outer rim of the standing wall portion 38*c* has substantially the same shape as a hollow portion 37*a* formed in the loop of the wound coil 37. Therefore, the coil 37 can be attached to the standing wall portion 38*c* so that the hollow portion 37*a* engages the outer rim of the standing wall portion 38*c*. For instance, the hollow portion 37*a* of the coil 37 has a length of 330 mm in the longitudinal direction X and a width of 10 mm in the Y direction perpendicular to the longitudinal direction X, while the outer rim of the standing wall portion 38*c* has a length of 329 mm in the longitudinal direction X and a width of 9.4 mm in the Y direction.

An inner rim of the standing wall portion 38*c* forms a rectangular space in which a pair of end center cores 42 is disposed. This rectangular space has a length corresponding to a paper passing region A for a paper sheet P of a maximum size in the longitudinal direction X that can be fixed. The thickness of the standing wall portion 38*c* is set so as to suppress radiation and conduction of heat of the excited coil 37 to the end center cores 42. For instance, a thickness of the standing wall portion 38*c* (length from the outer rim to the inner rim) is set to 1.5 mm, and a length of the rectangular space in the Y direction is set to 6.4 mm.

A pair of end center cores 42 is attached in the rectangular space of the standing wall portion 38*c*. The pair of end center cores 42 is disposed to correspond to non-paper passing regions C formed on both end portions of a paper passing region B for a small size paper sheet P when the paper sheet P smaller than a largest size paper sheet P passes through the nip portion N.

The end center cores 42 are formed of high magnetic permeability ferrite such as Mn—Zn alloy in a rectangular block shape. In addition, the Curie temperature thereof is set to a temperature of the end center core 42 (120 degrees Celsius) when the nip portion N becomes the fixable temperature, or to a higher temperature, and to a temperature lower than the Curie temperature of the arch core 41 (see FIG. 4). If the temperature of the end center core 42 exceeds the Curie temperature, the magnetic permeability of the end center core 42 is rapidly lowered so that the center core 42 does not act as a magnetic material. The Curie temperature of the end center core 42 is set to 130 degrees Celsius, for example, by adjusting a ratio between Mn and Zn of the Mn—Zn alloy. In addition, the thermal capacity of the end center core 42 is set to be smaller than that of the arch core 41. Dimensions of the end center core 42 are set as follows. For instance, a length (in the longitudinal direction X) is set to 18 mm, a width (length in the Y direction) is set to 5 mm, and a height is set to 7 mm. Calculating the thermal capacity of the end center core 42 from dimensions, specific gravity, and specific heat of the end center core 42, the thermal capacity of one end center core 42 becomes 2.7 J/K. Because the end center core 42 has smaller thermal capacity than the arch core 41 and is disposed close to the heating belt 26, temperature following property of the end center core 42 to a temperature variation of the heating belt 26 is superior to that of the arch core 41.

In addition, the Curie temperature of the end center core 42 is set to the cooling set temperature of the coil 37 (approximately 160 degrees Celsius) or lower. The heat resistance temperature of the coil 37 is 200 degrees Celsius. The cooling set temperature is a temperature set in consideration with the heat resistance temperature of the melting layer of the coil 37 (180 degrees Celsius). When the temperature of the coil 37 exceeds this cooling set temperature, the melting layer is melted so that an electrical short circuit may occur in the coil 37. Therefore, the coil 37 is cooled by an exhaust fan 57 described later (see FIGS. 9 to 11), and the Curie temperature of the end center core 42 is set to the cooling set temperature or lower. Thus, even if the temperature of the non-paper passing region of the heating belt 26 rises excessively, the end center core 42 becomes the Curie temperature appropriately to lose its magnetic property, and prevents the heating belt 26 from being broken by heat.

In the fixing device 5 of this embodiment, when power is supplied to the coil 37, magnetic permeabilities of the arch cores 41, the side cores 43, and the end center cores 42 are high as long as the nip portion N is maintained at substantially a predetermined fixing temperature or lower. Therefore, in FIG. 3, the magnetic flux generated from the coil 37 passes through a magnetic path including the induction heating layer 26*a* of the heating belt 26, the side core 43, and the arch core 41 in the paper passing region B (see FIG. 5). Thus, the eddy current flows in the induction heating layer 26*a* of the heating belt 26 by electromagnetic induction so that the induction heating layer 26*a* of the heating belt 26 generates heat. On the other hand, in the non-paper passing region C (see FIG. 5), the magnetic flux generated from the coil 37 passes through a magnetic path including the end center core 42, the induction heating layer 26*a* of the heating belt 26, the side core 43, and the arch core 41. Thus, eddy current flows in the induction heating layer 26*a* of the heating belt 26 by electromagnetic induction so that the induction heating layer 26*a* of the heating belt 26 generates heat. Usually, temperature at both end portions of the heating member including the heating belt 26 in the longitudinal direction X is apt to decrease more than the middle portion of the heating member by thermal radiation or heat conduction. However, because the end center core 42 is disposed at each end portion, heating value of the heating belt 26 at each end portion is increased so that temperature distribution of the heating belt 26 in the direction perpendicular to the paper conveying direction (longitudinal direction X) can be equalized.

In the case where a toner image is fixed onto a small size paper sheet, temperature of the non-paper passing region C (see FIG. 5) in the nip portion N is raised excessively over the predetermined fixing temperature, temperature of the end center core 42 disposed to be opposed to the non-paper passing region C is raised relatively rapidly by thermal radiation or heat conduction from the heating belt 26 to the end center core 42. The temperature of the end center core 42 is raised rapidly because the end center core 42 is disposed close to the heating belt 26, and because the thermal capacity is relatively small. By the similar reason, the temperature of the end center core 42 rapidly follows a decrease of temperature of the heating belt 26, too. Then, when the temperature of the end center core 42 exceeds the Curie temperature, the magnetic permeability of the end center core 42 is rapidly decreased so that the end center core 42 does not act as a magnetic material. Therefore, when the magnetic path including the end center core 42, the induction heating layer 26*a* of the heating belt 26, the side core 43, and the arch core 41 is cut off, the heating degree of the induction heating layer 26*a* of the heating belt 26 is largely decreased compared with before the magnetic path is cut. Therefore, surface temperature of the heating belt 26 is lowered. When the temperature of the non-paper passing region C of the nip portion N returns to the predetermined fixing temperature, the temperature of the end center core 42 becomes lower than this Curie temperature. Therefore, the induction heating layer 26*a* of the heating belt 26 is normally heated by electromagnetic induction again.

Note that the Curie temperature of the magnetic core 39 is set in consideration of the predetermined fixing temperature of the nip portion N and the heat resistance temperature of the heating member, the coil 37, and the like. If the magnetic core 39 does not have good temperature following property to a temperature rise of the heating belt 26, it takes time until temperature of the magnetic core 39 rises even if temperature of the heating belt 26 rises in the non-paper passing region C. It is necessary to set the Curie temperature of the magnetic core 39 so that temperature of the fixing roller 18 or the coil 37 does not exceed the heat resistance limit temperature resulting in a breakage of the member during the above-mentioned time. The end center core 42 has good temperature following property to the temperature rise of the heating belt 26. Therefore, the fixing roller 18 and the coil 37 are not broken by heat at the Curie temperature set in the end center core 42.

As illustrated in FIG. 6, the standing wall portion 38*c* of the bobbin 38 has a plurality of (five in this embodiment) protrusions 38*f* on a wall face on the rectangular space side. The plurality of protrusions 38*f* are used for positioning when the end center core 42 is attached to the bobbin 38. Two protrusions 38*f* are arranged on one wall face in the longitudinal direction X, and two protrusions 38*f* are arranged on the other wall face so as to be opposed to the above-mentioned two protrusions 38*f*. Further, one protrusion 38*f* is disposed on the wall face at an end in the Y direction. Note that it is possible to adopt a structure in which one protrusion 38*f* is disposed on the one wall face or the other wall face, and another protrusion 38*f* is disposed on the wall face at the end. In addition, the above-mentioned embodiment has the structure in which the standing wall portion 38*c* is formed, and the protrusion 38*f* is formed integrally with the standing wall portion 38*c*. However, in a case where the standing wall portion 38*c* is not formed in the bobbin 38, the protrusion 38*f* may be provided directly on the mounting surface 38*b* of the bobbin 38.

Therefore, in order to attach the end center core 42 to the bobbin 38, adhesive is applied to a predetermined position on the mounting surface 38*b* of the bobbin 38, and next the end center core 42 is set to contact with the plurality of protrusions 38*f* and is pushed in until it abuts the mounting surface 38*b*. In addition, the other end center core 42 is attached in the same manner as described above. Thus, the adhesive is distributed uniformly between the end center core 42 and the mounting surface 38*b*, and the end center core 42 is positioned at a predetermined position of the bobbin 38 to be securely fixed. Because of the correct attachment of the end center core 42 to a predetermined position of the bobbin 38, the thermal capacity of the above-mentioned end center core 42, and the location of the end center core 42 close to the heating belt 26, it is possible to prevent excessive temperature rise of the non-paper passing region C correctly and swiftly.

In addition, the above-mentioned embodiment has the structure in which the standing wall portion 38*c* of the bobbin 38 separates the end center core 42 from the coil 37. When power is supplied to the coil 37 so that the coil 37 generates magnetic flux, the coil 37 is self heated so that temperature of the coil 37 is raised. The standing wall portion 38*c* prevents the heat of the coil 37 from radiating to the end center core 42, and the temperature following property of the end center core 42 to a temperature variation of the heating belt 26 is further improved.

In addition, In the above-mentioned embodiment, the plurality of protrusions 38*f* are provided in the standing wall portion 38*c*, and the plurality of protrusions 38*f* contact with the end center core 42 in order to position the end center core 42. With this structure, a contacting portion of the end center core 42 with the standing wall portion 38*c* is reduced. Therefore, heat of the self-heated coil 37 is hardly conducted to the end center core 42, and hence the temperature following property of the end center core 42 to a temperature variation of the heating belt 26 is further improved.

Second Embodiment

Figure 7:
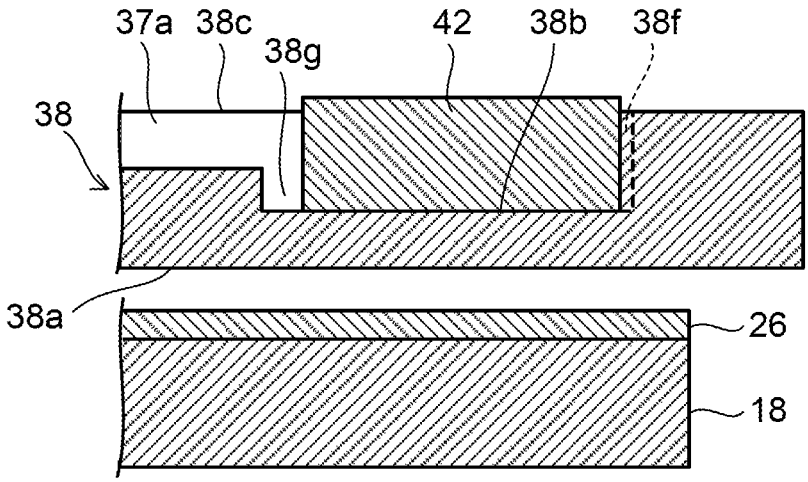
FIG. 7 is a plan cross-sectional view illustrating attachment of the end center cores to the bobbin according to a second embodiment of the present disclosure.

FIG. 7 is a plan cross-sectional view illustrating attachment of the end center core 42 to the bobbin 38 according to a second embodiment. In the second embodiment, a step portion 38*g* is formed in the attaching portion of the end center core 42 of the bobbin 38 (mounting surface 38*b*) of the first embodiment, so the attaching portion different from the first embodiment is mainly described, while descriptions of the same portions as the first embodiment are omitted.

The end center core 42 is disposed in the rectangular space formed by the standing wall portion 38*c* of the bobbin 38 (namely, the hollow portion 37*a* of the coil 37). The end center core 42 is positioned by the plurality of protrusions 38*f*. The mounting surface 38*b* is disposed in the step portion 38*g* formed in the rectangular space of the bobbin 38. A thickness of the step portion 38*g* (length from the opposed surface 38*a* to the mounting surface 38*b* of the bobbin 38) is set to 0.5 to 1 mm, for example, which is smaller than thicknesses of other portions of the bobbin 38. The end center core 42 is attached to the mounting surface 38*b* with adhesive.

With this structure, the end center core 42 is disposed closer to the heating belt 26, and the heating value of the heating belt 26 by the electromagnetic induction is rapidly increased in both end portions in the direction perpendicular to the paper conveying direction. Thus, it is possible to rapidly equalize temperature distribution in the direction perpendicular to the paper conveying direction. In addition, when a toner image is fixed onto a small size paper sheet, the end center core 42 rapidly follows a temperature rise of the heating belt 26. Therefore, it is possible to rapidly prevent temperature of the non-paper passing region of the heating belt 26 from rising excessively.

Third Embodiment

Figure 8:
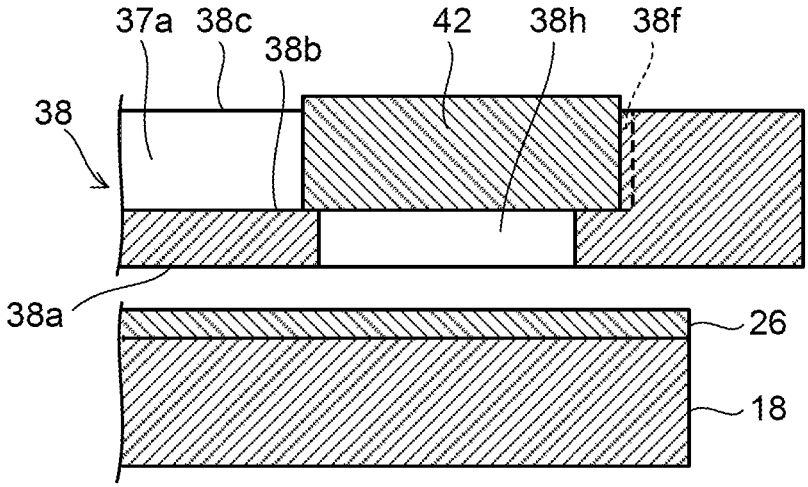
FIG. 8 is a plan cross-sectional view illustrating attachment of the end center cores to the bobbin according to a third embodiment of the present disclosure.

FIG. 8 is a plan cross-sectional view illustrating attachment of the end center core 42 to the bobbin 38 according to a third embodiment. In the third embodiment, an opening portion 38*h* is formed in the attaching portion of the end center core 42 of the bobbin 38 according to the first embodiment.

The end center core 42 is disposed in the rectangular space formed by the standing wall portion 38*c* of the bobbin 38 (namely, the hollow portion 37*a* of the coil 37). The end center core 42 is positioned by the plurality of protrusions 38*f*. An opening portion 38*h* opened toward the heating belt 26 is formed in a portion of the bobbin 38 to which the end center core 42 is attached. When the end center core 42 is attached to the mounting surface 38*b* with adhesive, heat of the heating belt 26 is conducted to the end center core 42 via the opening portion 38*h*.

With this structure, the heating value of the heating belt 26 by the electromagnetic induction is rapidly increased in both end portions in the direction perpendicular to the paper conveying direction. Thus, it is possible to rapidly equalize temperature distribution of the heating belt 26 in the direction perpendicular to the paper conveying direction. In addition, when a toner image is fixed onto a small size paper sheet, the temperature of the end center core 42 rapidly follows a temperature rise of the heating belt 26. Therefore, it is possible to rapidly prevent temperature of the non-paper passing region of the heating belt 26 from rising excessively.

Fourth Embodiment

Figure 9:
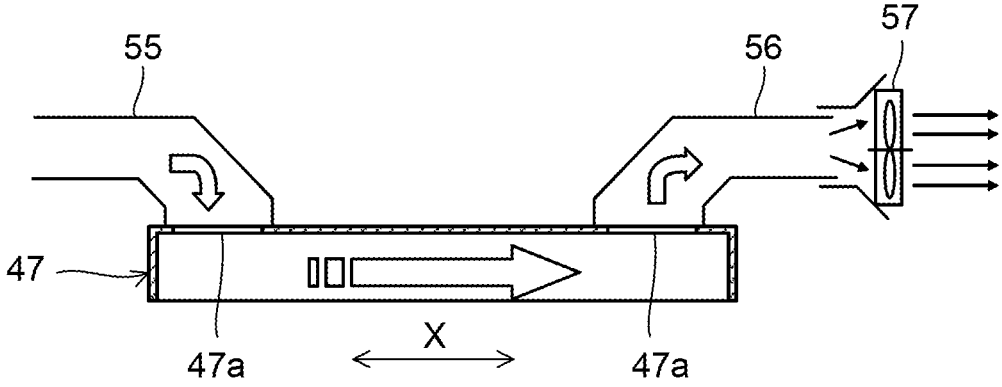
FIG. 9 is a plan cross-sectional view illustrating an exhaust fan and a ventilation duct which exhausts heat of the induction heating portion according to a fourth embodiment of the present disclosure.
Figure 10:
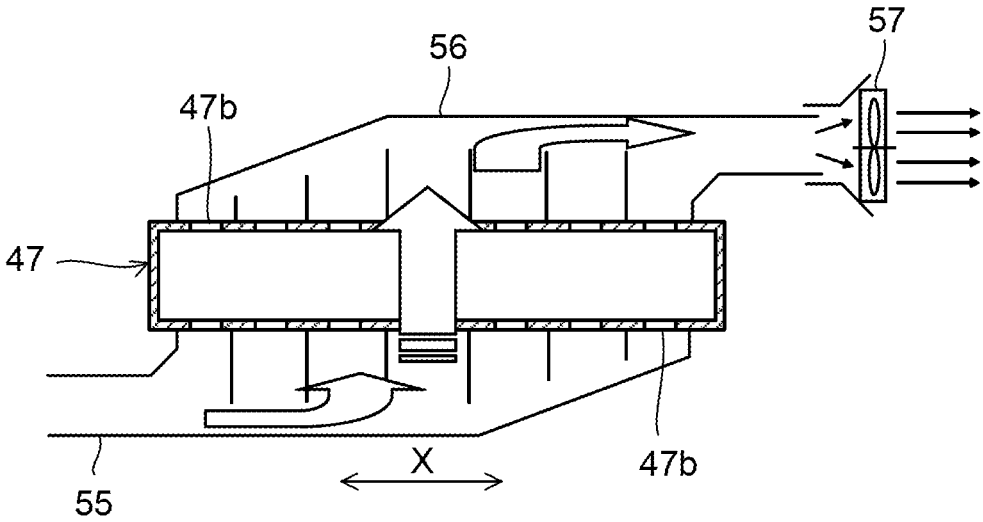
FIG. 10 is a plan cross-sectional view illustrating a variation example of arrangement of the exhaust fan and the ventilation duct according to the fourth embodiment of the present disclosure.
Figure 11:
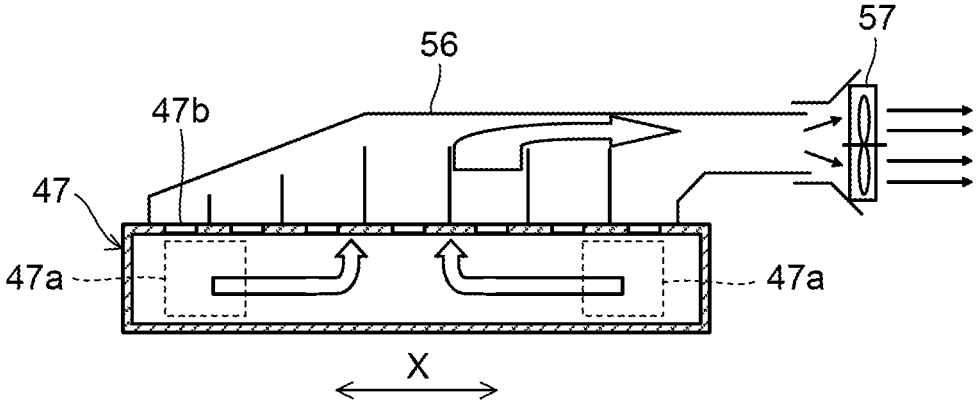
FIG. 11 is a plan cross-sectional view illustrating another variation example of arrangement of the exhaust fan and the ventilation duct according to the fourth embodiment of the present disclosure.

A fourth embodiment includes an exhaust fan and a ventilation duct for exhausting heat of the induction heating portion 30. FIG. 9 is a plan cross-sectional view of the exhaust fan and the ventilation duct for exhausting heat in the cover member 47 according to the first to the third embodiments, viewed from the side. In addition, FIGS. 10 and 11 illustrate variation examples of FIG. 9, and are plan cross-sectional views of arrangements of the exhaust fan and the ventilation duct, viewed from the top.

As illustrated in FIG. 9, when power is supplied to the coil 37 so that the coil 37 (see FIG. 3) generates the magnetic flux, the coil 37 is self heated, and temperature in the cover member 47 rises. In order to suppress an increase of temperature of the coil 37, the exhaust fan 57 and ventilation ducts 55 and 56 as air paths are disposed. The exhaust fan 57 and the ventilation ducts 55 and 56 constitute a cooling mechanism.

Upper face openings 47*a* are formed on an upper face portion of the cover member 47. The upper face openings 47*a* are respectively disposed on both end sides of the cover member 47 in the longitudinal direction X. The ventilation duct 55 is disposed to be opposed to the one upper face opening 47*a*, and the ventilation duct 56 is disposed to be opposed to the other upper face opening 47*a*. The ventilation duct 56 is attached so that the opening on one end side is opposed to the upper face opening 47*a* and the opening on the other end side is opposed to the exhaust fan 57.

When the exhaust fan 57 is driven to rotate, external air enters the cover member 47 from the ventilation duct 55 through the upper face opening 47*a*. This air flow caused by the exhaust fan 57 exhausts heat generated in the coil 37 (see FIG. 3) externally from the ventilation duct 56 through the upper face opening 47*a*.

Because the exhaust fan 57 cools the coil 37, heat of the coil 37 is prevented from radiating to the magnetic core 39. Thus, temperature following property of the magnetic core 39 to a temperature variation of the heating belt 26 is improved.

In a variation example illustrated in FIG. 10, a plurality of side face openings 47*b* are respectively formed on both side face portions of a cover member 47. A ventilation duct 55 is disposed to be opposed to the side face openings 47*b* on one side, and a ventilation duct 56 is disposed to be opposed to the side face openings 47*b* on the other side. The ventilation duct 56 is attached so that an opening on one end side is opposed to the side face openings 47*b* and an opening on the other end side is opposed to an exhaust fan 57.

When the exhaust fan 57 is driven to rotate, external air enters the cover member 47 from the ventilation duct 55 through the side face opening 47*b*. This air flow caused by the exhaust fan 57 exhausts heat generated in the coil 37 (see FIG. 3) externally from the ventilation duct 56 through the side face opening 47*b*.

Because the exhaust fan 57 cools the coil 37, heat of the coil 37 is prevented from radiating to the magnetic core 39. Thus, temperature following property of the magnetic core 39 to a temperature variation of the heating belt 26 is improved.

In another variation example illustrated in FIG. 11, the upper face openings 47*a* are formed on the upper face portion of the cover member 47, and the upper face openings 47*a* are respectively disposed on both end sides of the cover member 47 in the longitudinal direction X. In addition, the plurality of side face openings 47*b* are formed on one side face portion of the cover member 47. Ventilation ducts (not shown) are disposed to be opposed to the upper face openings 47*a*, respectively, and a ventilation duct 56 is disposed to be opposed to the side face openings 47*b*. The ventilation duct 56 is attached so that the opening on one end side is opposed to the side face openings 47*b* and the opening on the other end side is opposed to the exhaust fan 57.

When the exhaust fan 57 is driven to rotate, external air enters the cover member 47 from the ventilation ducts (not shown) disposed to be opposed to the upper face openings 47*a* through the upper face openings 47*a*. This air flow caused by the exhaust fan 57 exhausts heat generated in the coil 37 (see FIG. 3) externally from the ventilation duct 56 through the side face opening 47*b*.

Because the exhaust fan 57 cools the coil 37, heat of the coil 37 is prevented from radiating to the magnetic core 39. Thus, temperature following property of the magnetic core 39 to a temperature variation of the heating belt 26 is improved.

Note that the above embodiment describes the example of application to the fixing device 5 in which the heating belt 26 is stretched around the fixing roller 18, but the present disclosure is not limited to this structure. The present disclosure may be applied to a fixing device having a structure in which an endless heating belt is stretched around between the heat roller disposed to be opposed to the induction heating portion and the fixing roller to which the pressure roller is pressed. In addition, the present disclosure may be applied to a fixing device having a structure including an induction heating portion which heats an endless heating belt, a pressure roller which is pressed to an outer circumference surface of the heating belt, and a pressing member disposed on an inner circumference surface of the heating belt to press the paper sheet and the heating belt with the pressure roller. Further, the present disclosure can be applied to various fixing devices including the induction heating portion, such as a fixing device including a pressure roller and a heating roller pressed to the pressure roller in which the heating roller includes an induction heating layer and is disposed to be opposed to the induction heating portion.

In addition, the above embodiment describes a structure in which the arch core 41 and the side core 43 are disposed separately, but the present disclosure is not limited to this structure. It is possible to adopt a structure in which the arch core 41 is extended toward the side core 43 so that the function of the side core 43 is achieved by the arch core 41.

In addition, the above embodiment describes a structure in which the arch core 41 is attached to the bobbin 38 via the arch core holder 45, but the present disclosure is not limited to this structure. It is possible to adopt a structure in which the arch core 41 is directly attached to the bobbin 38.

The present disclosure can be used for a fixing device to be used for a copier, a printer, a facsimile, a multifunctional peripheral thereof, or the like, and can be used for an image forming apparatus including the fixing device. In particular, the present disclosure can be used for an electromagnetic induction heating type fixing device and an image forming apparatus including the same.

What is claimed is:

1. A fixing device comprising:

a heating member;

a pressure member pressed to the heating member;

a nip portion formed by pressure between the heating member and the pressure member so as to sandwich a recording medium carrying an unfixed toner image for melting and fixing the unfixed toner image on the recording medium;

a coil wound in a loop shape in a longitudinal direction of the heating member so as to generate a magnetic flux for induction heating of the heating member;

a cooling mechanism for cooling the coil;

a magnetic core disposed close to the coil in a direction perpendicular to a conveying direction of the recording medium so as to guide the magnetic flux to an induction heating layer of the heating member; and a support member which is opposed to a surface of the heating member and has a mounting surface opposite to a surface opposed to the heating member, on which the coil and the magnetic core are mounted, wherein the magnetic core includes a plurality of first core portions arranged to surround the coil in the direction perpendicular to the conveying direction of the recording medium, and a second core portions disposed closer to the heating member than the first core portion on both end portions in the direction perpendicular to the conveying direction of the recording medium in a hollow portion formed by the coil loop, and the second core portion has a thermal capacity smaller than that of the first core portion, and Curie temperature of the second core portion is a temperature of the second core portion or higher when a temperature of the heating member becomes a fixable temperature and is a cooling set temperature of the coil or lower.

2. The fixing device according to claim 1, further comprising a cover member attached to the support member so as to cover the magnetic core and the coil, wherein the cooling mechanism includes an exhaust fan for exhausting air around the coil, and an air path for exhausting air in the cover member externally through an opening formed in the cover member.

3. The fixing device according to claim 1, wherein a standing wall portion for separating the second core portion from the coil is formed on the support member, and a plurality of protrusions are formed on the standing wall portion, and the second core portion contacts with the plurality of protrusions and is attached to the mounting surface of the support member.

4. The fixing device according to claim 1, wherein thickness of the support member of a portion corresponding to the hollow portion of the coil in an attaching portion for the second core portion is smaller than in other portions.

5. The fixing device according to claim 1, wherein the attaching portion of the support member for the second core portion has an opening portion opened toward the heating member.

6. An image forming apparatus comprising the fixing device according to claim 1.

* * * * *